US005322029A

United States Patent [19]

Fujita

[11] Patent Number: 5,322,029

[45] Date of Patent: Jun. 21, 1994

[54] REMAINING BOBBIN-THREAD AMOUNT MEASURING APPARATUS FOR SEWING MACHINE

[75] Inventor: Tomoyuki Fujita, Tajimi, Japan

[73] Assignee: Brother Kogyo Kabushiki Kaisha, Nagoya, Japan

[21] Appl. No.: 76,101

[22] Filed: Jun. 14, 1993

[30] Foreign Application Priority Data

Jul. 15, 1992 [JP] Japan ..... 4-187958

[51] Int. Cl.[5] ..... D05B 59/02; D05B 69/36

[52] U.S. Cl. ..... 112/278; 242/37 R

[58] Field of Search ..... 112/278, 273; 242/37 R, 242/37 A, 38

[56] References Cited

U.S. PATENT DOCUMENTS 4,216,733 8/1980 Kornatowski ..... 112/273 X
4,250,825 2/1981 Kamiyama ..... 112/278

FOREIGN PATENT DOCUMENTS 2056427 5/1972 Fed. Rep. of Germany ..... 112/278
61-43075 9/1986 Japan .
61-180685 11/1986 Japan .
2186893 8/1987 Japan ..... 112/273
63-136591 9/1988 Japan .

*Primary Examiner*—Peter Nerbun
*Attorney, Agent, or Firm*—Oliff & Berridge

[57] ABSTRACT

An apparatus for measuring a remaining amount of a bobbin thread which is wound around a bobbin accommodated in a shuttle of a sewing machine, including a measurement bar which is displaceable along a displacement path from outside the shuttle toward an axis line of the bobbin inside the shuttle, a measurement-bar driver which displaces the measurement bar along the displacement path so that a free end of the measurement bar contacts an outer surface of a roll of the bobbin thread remaining on the bobbin, a displacement-speed control device which controls the measurement-bar driver to displace the measurement bar such that the free end of the measurement bar contacts the outer surface of the roll of the bobbin thread at a speed lower than a highest speed of the displacement of the bar along the displacement path, and a remaining-amount determining device which determines the remaining amount of the bobbin thread on the bobbin, based on an amount of the displacement of the measurement bar along the displacement path when the free end of the measurement bar contacts the outer surface of the roll of the bobbin thread.

19 Claims, 10 Drawing Sheets

REMAINING BOBBIN-THREAD AMOUNT MEASURING APPARATUS FOR SEWING MACHINE

BACKGROUND OF THE INVENTION

1. Field of the Invention

The present invention relates to an apparatus for measuring the remaining amount of bobbin thread wound on a bobbin accommodated in a shuttle of a sewing machine.

2. Related Art Statement

Japanese Unexamined Utility Model Application laid open under Publication No. 61(1986)-180685 discloses an example of the remaining bobbin-thread amount measuring apparatus. The disclosed apparatus is of optical type wherein, when the rotation of a rotating hook of a shuttle is stopped, a light is emitted toward the outer surface of a roll of bobbin thread wound on a bobbin accommodated in the rotating hook and the light reflected from the roll of bobbin thread and detected by an optical sensor is utilized for determining the amount of the bobbin thread remaining on the bobbin. However, the sensitivity of the optical sensor is lowered due to dust or oil adhered thereto. Another problem with the prior apparatus is that the sensitivity of the optical sensor changes depending upon colors of bobbin thread. Thus, in some cases, the optical-type apparatus cannot accurately measure the remaining amount of bobbin thread.

Meanwhile, Japanese Examined Patent Application laid open for opposition purpose under Publication No. 61(1986)-43075 discloses a near-end detecting apparatus. The disclosed apparatus is of mechanical type which includes (a) a measurement bar which is displaceable along a displacement path from outside a shuttle toward the axis line of a bobbin accommodated in the shuttle, (b) a meaurement-bar driver which displaces the measurement bar along the displacement path so that a free end of the bar contacts the outer surface of a roll of bobbin thread remaining on the bobbin, after the rotation of the shuttle has been stopped, the driver retracting the measurement bar away from the outer limit of a locus of rotation of the shuttle before the rotation of the shuttle is re-started, and (c) a near-end microswitch which is adapted to close when the displacement amount of the measurement bar necessary for the bar to contact the bobbin thread exceeds a predetermined value while the bobbin thread is gradually consumed, the closing of the microswitch triggering an alarm. Thus, the near-end detecting apparatus identifies with accuracy that the remaining bobbin-thread amount has been reduced to near-end, i.e., near-zero.

However, in the near-end detecting apparatus, the measurement-bar driver continues to drive the measurement bar till the bar contacts the bobbin thread on the bobbin. Consequently, the measurement bar collides with the bobbin thread or the bobbin at an excessively high speed. Therefore, as the remaining bobbin-thread amount decreases, the bobbin thread more frequently breaks or damages because of being nipped between the bobbin and the moving bar.

SUMMARY OF THE INVENTION

It is therefore an object of the present invention to provide an apparatus which measures a remaining bobbin-thread amount by effectively avoiding breakage of the bobbin thread.

The above object has been achieved by the present invention. According to a first aspect of the present invention, there is provided an apparatus for measuring a remaining amount of a bobbin thread which is wound around a bobbin accommodated in a shuttle of a sewing machine, comprising (a) a measurement bar which is displaceable along a displacement path from outside the shuttle toward an axis line of the bobbin inside the shuttle, (b) a measurement-bar driver which displaces the measurement bar along the displacement path so that a free end of the measurement bar contacts an outer surface of a roll of the bobbin thread remaining on the bobbin, (c) a displacement-speed control device which controls the measurement-bar driver to displace the measurement bar such that the free end of the measurement bar contacts the outer surface of the roll of the bobbin thread at a speed lower than a highest speed of the displacement of the bar along the displacement path, and (d) remaining-amount determining means for determining the remaining amount of the bobbin thread on the bobbin, based on an amount of the displacement of the measurement bar along the displacement path when the free end of the measurement bar contacts the outer surface of the roll of the bobbin thread.

In the remaining bobbin-thread amount measuring apparatus constructed as described above, the displacement-speed control device controls the measurement-bar driver to displace the measurement bar such that the bar contacts the bobbin thread at a speed lower than the highest speed of the displacement of the bar, most preferably at a speed approximately equal to zero. Thus, the present measuring apparatus measures a remaining bobbin-thread amount by effectively avoiding breakage or damage of the bobbin thread which otherwise might occur due to being nipped between the bobbin and the moving bar. Therefore, the employment of the present apparatus in a sewing machine does not result in lowering the sewing efficiency of the sewing machine. In addition, the present apparatus is free from a problem that bobbin thread easily breaks in a product sewed by a sewing machine in which a remaining bobbin-thread measuring apparatus is employed.

According to a preferred feature of the present invention, the measurement-bar driver comprises an electric solenoid, the displacement-speed control device energizing the electric solenoid in at least one energization period of time and deenergizing the solenoid in at least one deenergization period of time such that the energization and deenergization periods are alternate with each other. The alternate energization and deenergization periods may consist of an energization period and a subsequent deenergization period. Alternatively, the alternate energization and deenergization periods may consist of a first energization period, a deenergization period, and a second energization period in time sequence. Alternatively, the measurement-bar driver may comprise a direct-current motor and a feed screw connected to the motor. In the latter case, the displacement speed of the measurement bar may be controlled by changing the magnitude of direct current supplied to the motor.

According to another feature of the present invention, the displacement-speed control device controls the measurement-bar driver to displace the measurement bar such that, when the measurement bar contacts the bobbin on which approximately no bobbin thread remains, the speed of the bar is equal to a value which does not cause breakage of the bobbin thread being nipped between the bobbin and the bar. That speed value may be zero.

According to yet another feature of the present invention, the displacement-speed control device controls, based on the remaining amount of the bobbin thread determined in a prior measurement cycle, the measurement-bar driver in a current measurement cycle to displace the measurement bar such that, when the measurement bar contacts the bobbin thread remaining on the bobbin in the current measurement cycle, the speed of the bar is substantially equal to a predetermined value. The predetermined value may be zero.

According to a further feature of the present invention, the measuring apparatus further comprises a displacement sensor which detects the displacement of the measurement bar, the sensor generating a displacement signal representative of the amount of the displacement of the measurement bar along the displacement path. The displacement sensor may comprise a Hall element and a permanent magnet.

In a preferred embodiment of the present invention, the measurement-bar driver comprises an actuator including an output member, and a connector member provided between the output member of the actuator, and the displacement bar, so as to connect the output member and the displacement bar to each other such that the bar is displaceable along an axis line thereof together with the connector member when the output member is moved by the actuator. The actuator may comprise a rotary actuator which rotates the output member about an axis line of the actuator so that the output member displaces the measurement bar along the axis line thereof. Alternatively, the actuator may be a linear actuator such as a linear motor.

According to a second aspect of the present invention, there is provided a bobbin-thread supplying apparatus for supplying a bobbin thread which cooperates with a needle thread carried by a sewing needle of a sewing machine to form stitches into a work sheet, comprising (A) a shuttle including a bobbin around which the bobbin thread is wound, a rotating hook which is rotatable for catching the needle thread, the rotating hook defining an outer limit of a locus of rotation of the shuttle, and a rotating-hook driver which rotates the rotating hook; (B) a remaining bobbin-thread amount measuring device including a measurement bar which is displaceable along a displacement path from outside the shuttle toward an axis line of the bobbin inside the shuttle, a measurement-bar driver which displaces the measurement bar along the displacement path so that a free end of the measurement bar contacts an outer surface of a roll of the bobbin thread remaining on the bobbin, a displacement-speed control device which controls the measurement-bar driver to displace the measurement bar such that the free end of the measurement bar contacts the outer surface of the roll of the bobbin thread at a speed lower than a highest speed of the displacement of the bar along the displacement path, remaining-amount determining means for determining the remaining amount of the bobbin thread on the bobbin, based on an amount of the displacement of the measurement bar along the displacement path when the free end of the measurement bar contacts the outer surface of the roll of the bobbin thread; and (C) an operation control device which controls operation of the rotating-hook driver and operation of the remaining bobbin-thread amount measuring device.

According to a feature of the second aspect of the present invention, the shuttle further includes a bobbin case which accommodates the bobbin, the bobbin case having an aperture which allows the free end of the measurement bar to pass therethrough and contact the outer surface of the roll of the bobbin thread remaining on the bobbin.

BRIEF DESCRIPTION OF THE DRAWINGS

The above and optional objects, features and advantages of the present invention will be better understood by reading the following detailed description of the presently preferred embodiments of the invention when considered in conjunction with the accompanying drawings in which.

DETAILED DESCRIPTION OF THE PREFERRED EMBODIMENTS

Figure 1:
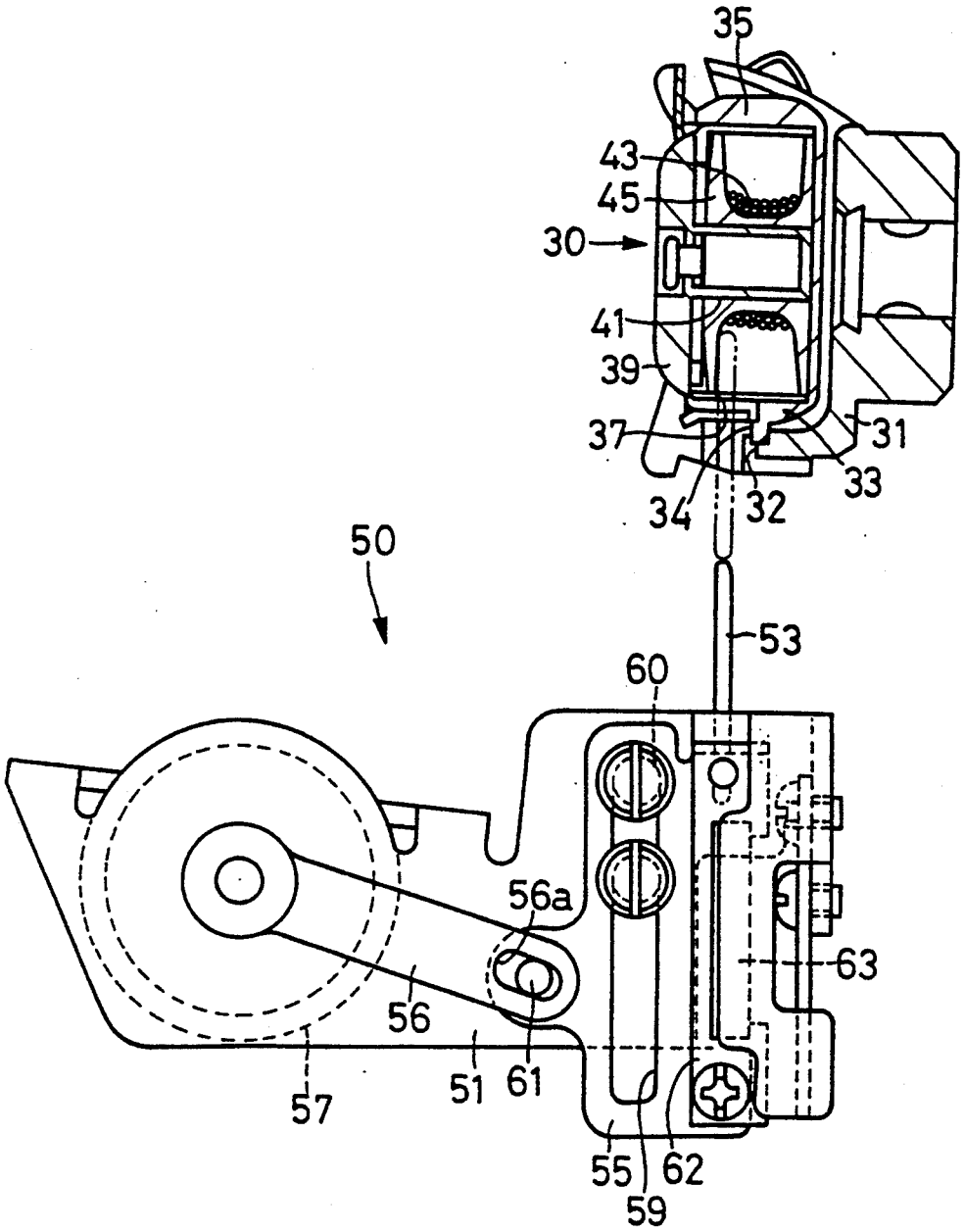
FIG. 1 is a front view of a remaining bobbin-thread amount measuring apparatus embodying the present invention, the measuring apparatus being employed in a bobbin-thread supplying apparatus of an automatic sewing machine.
Figure 2:
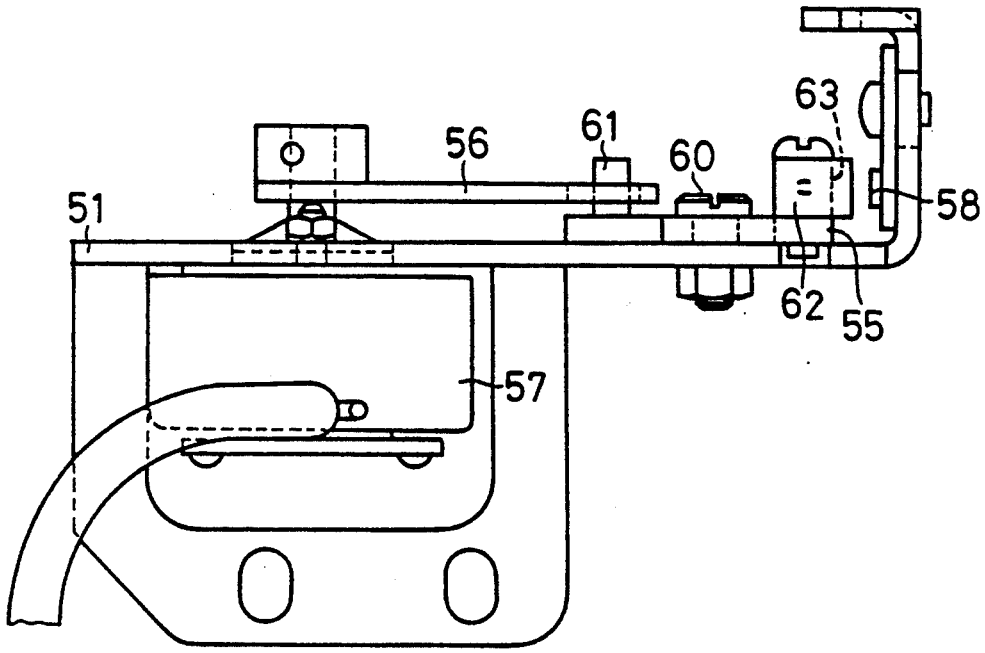
FIG. 2 is a bottom view of the measuring apparatus of FIG. 1.

Referring to FIGS. 1 and 2, there is shown a remaining bobbin-thread amount monitor embodying the present invention. The bobbin thread monitor is employed in a bobbin-thread supplying apparatus for an automatic sewing machine.

The present bobbin thread monitor is applied to an automatic sewing machine (FIG. 5) having a shuttle 30 which is provided in the bed of the sewing machine and cooperates with a vertically reciprocatable sewing needle to catch a needle thread carried by the needle and thereby form lock stitches into a work sheet such as a fabric or leather.

As shown in FIG. 1, the shuttle 30 includes a rotating hook 31 which is rotatable in synchronism with the vertical reciprocation of the sewing needle, and a bobbin case holder 33 which is disposed stationary inside the rotating hook 33. The bobbin case holder 33 includes a cylindrical holder portion 35 inside which a bobbin case 39 having an aperture 37 in the cylindrical wall thereof detachably fits in position. With the bobbin case 39 fitting in position in the bobbin case holder 33, the aperture 37 of the bobbin case 39 faces vertically downward.

The bobbin case 39 includes an axially extending, hollow support portion 41 on which a bobbin 45, around which a bobbin thread 43 is wound, detachably and rotatably fits. The rotating hook 31 and the bobbin case holder 33 have a first opening 32 and a second opening 34, respectively. The second opening 34 of the bobbin case holder 33 is aligned with the aperture 37 of the bobbin case 39 fitted in position in the holder 33. When the sewing operation of the sewing machine is ended, the rotation of the rotating hook 31 is automatically stopped at a predetermined angular position in which the first opening 32 of the rotating hook 31 is aligned with the aperture 37 of the bobbin case 39 and the second opening 34 of the bobbin case holder 33.

Vertically downward of the shuttle 30, there is disposed a detector part 50 of the present bobbin thread monitor. The detector part 50 is secured to a frame member of the sewing machine with the help of a mount plate 51. The detector part 50 includes a measurement bar 53 and a slider member 55 to which the measurement bar 53 is fixed. The slider member 55 is supported by the mount plate 51 such that the slider member 55 is vertically displaceable relative to the mount plate 51 and such that the measurement bar 55 is vertically displaceable along the axis line thereof together with the slider member 55. The mount plate 51 also supports a rotary solenoid 57 which drives or displaces the measurement bar 53 via an arm member 56. In the present embodiment, the rotary solenoid 57 serves as a driver which displaces the measurement bar 53 along a predetermined displacement path relative to the bobbin 45 of the shuttle 30.

As shown in FIG. 2, the mount plate 51 further supports a Hall element 58 which generates an electric signal whose magnitude of voltage is proportional with the magnitude of magnetic field in which the Hall element 58 stands. More specifically, the voltage of the electric signal generated from the Hall element 58 is proportional with the magnitude of a component of the magnetic field of a permanent magnet 63 which component is parallel to the horizontal direction as seen in FIG. 1. The N and S poles of the permanent magnet 63 correspond to the upper and lower end portions thereof as seen in FIG. 1, respectively. When the middle portion of the magnet 63 is just aligned with the Hall element 58, the magnitude of the pertinent component of the magnetic field becomes zero and therefore the magnitude of the electric signal becomes zero volt. However, a bias voltage is added to the electric signal in the Hall element 58. The electric signal generated from the Hall element 58 is represented by, for example, a curve shown in FIG. 8 (described in detail later).

The slider member 55 has an elongate slot 59, and is supported by the mount plate 51, with the help of screws 60 extending through the elongate slot 59 and secured to the mount plate 51, such that the slider member 55 is vertically displaceable by being guided by the slot 59 and screws 60. The slider member 55 has an engagement pin 61 which extends through, and is engaged with, an elliptic hole 56*a* formed through a free-end portion of the arm member 56. The measurement bar 53 is fixed to the slider member 55 via a magnet holder 62 which supports at the middle portion thereof the permanent magnet 63.

As shown in FIG. 2, the Hall element 58 is opposed to the permanent magnet 63. The voltage produced in the Hall element 58 due to the magnetic field of the permanent magnet 63, varies with the relative position of the measurement bar 53 to the Hall element 58. Therefore, the voltage variation in the Hall element 58 provides a displacement signal whose magnitude varies with the relative position of the bar 53, i.e., displacement amount of the bar 53 along the predetermined displacement path thereof. The curve of the displacement signal shown in FIG. 8 can be approximated by a straight line that is expressed by a linear function equation.

As described previously, the rotation of the rotating hook 31 is automatically stopped at the predetermined angular position, so that the aperture 37 of the bobbin case 39 is exposed outside through the first and second openings 32, 34 of the rotating hook 31 and the bobbin case holder 33. That is, the aperture 37 vertically downwardly faces the measurement bar 53 of the detector part 50. In this situation, upon energization of the rotary solenoid 57, the arm member 56 is rotated in a counterclockwise direction as seen in FIG. 1, so that the slider member 55 vertically upwardly displaces because of the engagement of the hole 56*a* and the pin 61. Together with the slider member 55, the magnet holder 62, permanent magnet 63 and measurement bar 53 all fixed to the slider member 55 are vertically upwardly displaced.

Figure 3:
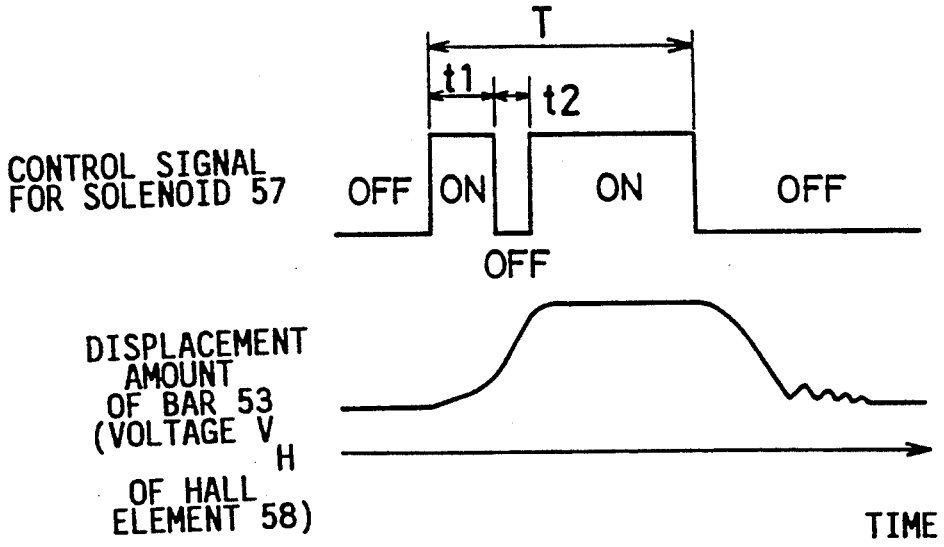
FIG. 3 shows a graph representing the control signal supplied to a solenoid serving as a driver for displacing a measurement bar, in association with a graph representing the displacement amount of the measurement bar.

As shown in FIG. 3, the rotary solenoid 57 is energized in a time period, $t_1$, which is predetermined such that in time period $t_1$ the slider member 55 receives from the energized solenoid 57 kinetic energy enough to displace the measurement bar 53 till the bar 53 reaches the axial portion 41 of the bobbin 45. Subsequently, the rotary solenoid 57 is deenergized in a time period, $t_2$, which is predetermined such that the bar 53 reaches the axial portion 41 of the bobbin due to the inertia of the slider member 55 and all other members fixed to the slider member 55. In the present embodiment, time periods $t_1$, $t_2$ are predetermined such that the measurement bar 53 contacts the bobbin thread 43 remaining on the bobbin 45 at a speed which is lower than the highest speed of the displacement of the bar 53 along the displacement path and which speed does not cause breakage of the bobbin thread 43 being nipped between the bobbin 45 and the moving bar 53. It is preferred that the speed of the bar 53 be approximately equal to zero when the bar 53 would contact the axial portion 41 of the bobbin 45 on which no bobbin thread 43 is assumed to remain.

Thereafter, the rotary solenoid 57 is energized again till a time, T, has passed as counted from the commencement of time period tl. In time period T, the voltage generated in the Hall element 58 becomes stable. In addition, the measurement bar 53 will surely contact the bobbin thread 43 remaining on the bobbin 45, even if the kinetic energy given to the slider member 55 or measurement bar 53 in first energization period $t_1$ were not enough. However, the second energization period subsequent to deenergization period $t_2$ may be omitted in the case where first energization period $t_1$ is predetermined to be so longer that the measurement bar 5 would contact the bobbin 45 on which no bobbin thread 43 is assumed to remain, at a speed considerably higher than zero. In either case, is minimized the impact exerted to the measurement bar 53 when the bar 53 would contact the axial portion 41 of the bobbin 45 on which no bobbin thread 43 is assumed to remain.

Thus, the measurement bar 53 is displaced along the displacement path thereof relative to the bobbin 45 of the shuttle 30 through the first and second openings 32, 34 and aperture 37, as shown in two-dot chain line in FIG. 1, till the upper, free end of the bar 53 eventually contacts the bobbin thread 43 remaining on the bobbin 45. The amount of displacement of the measurement bar 53 till the bar 53 contacts the bobbin thread 43 corresponds to the remaining amount of the bobbin thread 43 on the bobbin 45. As described above, that displacement amount of the bar 53 is detected by the Hall element 58.

Subsequently, upon deenergization of the rotary solenoid 57, the arm member 56 is rotated in the reverse or clockwise direction to the displacement start position thereof due to the biasing force of a spring (not shown) provided in the solenoid 57. By this return of the arm member 56, the slider member 55, measurement bar 53, magnetic holder 62 and permanent magnet 63 are also vertically downwardly displaced so as to be retracted to the displacement start position thereof defined by the engagement of the top one screw 60 and the top end of the slot 59 of the slider member 55.

Figure 4:
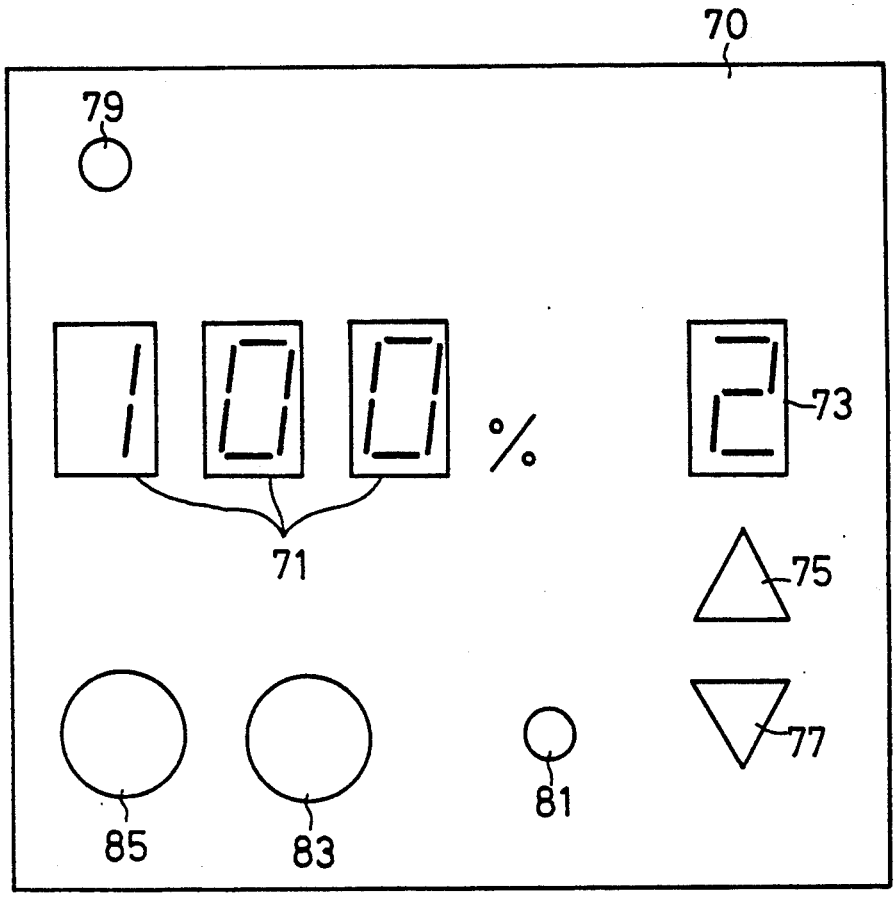
FIG. 4 is a front view of a display panel as a part of the measuring apparatus of FIG. 1.

The present bobbin thread monitor further includes a display panel 70 as shown in FIG. 4. The display panel 70 includes, at a central portion thereof, a remaining bobbin-thread amount display (first display) 71 which is constituted by three seven-segment digital indicators and which indicates a remaining amount in percentage of the bobbin thread 43 wound on the bobbin 45.

Adjacent the first display 71, is provided a reference bobbin-thread amount display (second display) 73 which is constituted by a single seven-segment digital indicator. The second display 73 indicates a single-figure value indicative of a reference bobbin-thread amount which is set or selected by an operator. When the actual remaining amount of the bobbin thread 43 becomes smaller than the selected reference amount, an alarm is issued. A predetermined look-up table defining the relationship between the reference bobbin-thread amounts and the single-figure values set on the second display 73 is pre-stored in a read only memory (ROM) of a control circuit 90 (FIG. 5, described later) of the present bobbin thread monitor.

The display panel 70 also includes, below the second display 73, an increment key 75 for increasing the value indicated on the second display 73 by increments of one, and a decrement key 77 for decreasing the value indicated on the second display 73 by decrements of one.

Additionally, the display panel 70 includes an alarm lamp 79 and an alarm buzzer 81 which are lighted and triggered, respectively, when the actual remaining amount of the bobbin thread 43 is decreased to less than the reference amount or level corresponding to the single-figure value set on the second display 73. A reset key 83 for stopping the alarming of the buzzer 81, is also provided on the display panel 70.

The display panel 70 further includes a calibration key 85 for calibrating the Hall element 58, i.e., determining a characteristic of the displacement signal generated from the Hall element 58, and storing data indicative of the determined signal characteristic in a random access memory (RAM) 97 of the control circuit 90.

Figure 5:
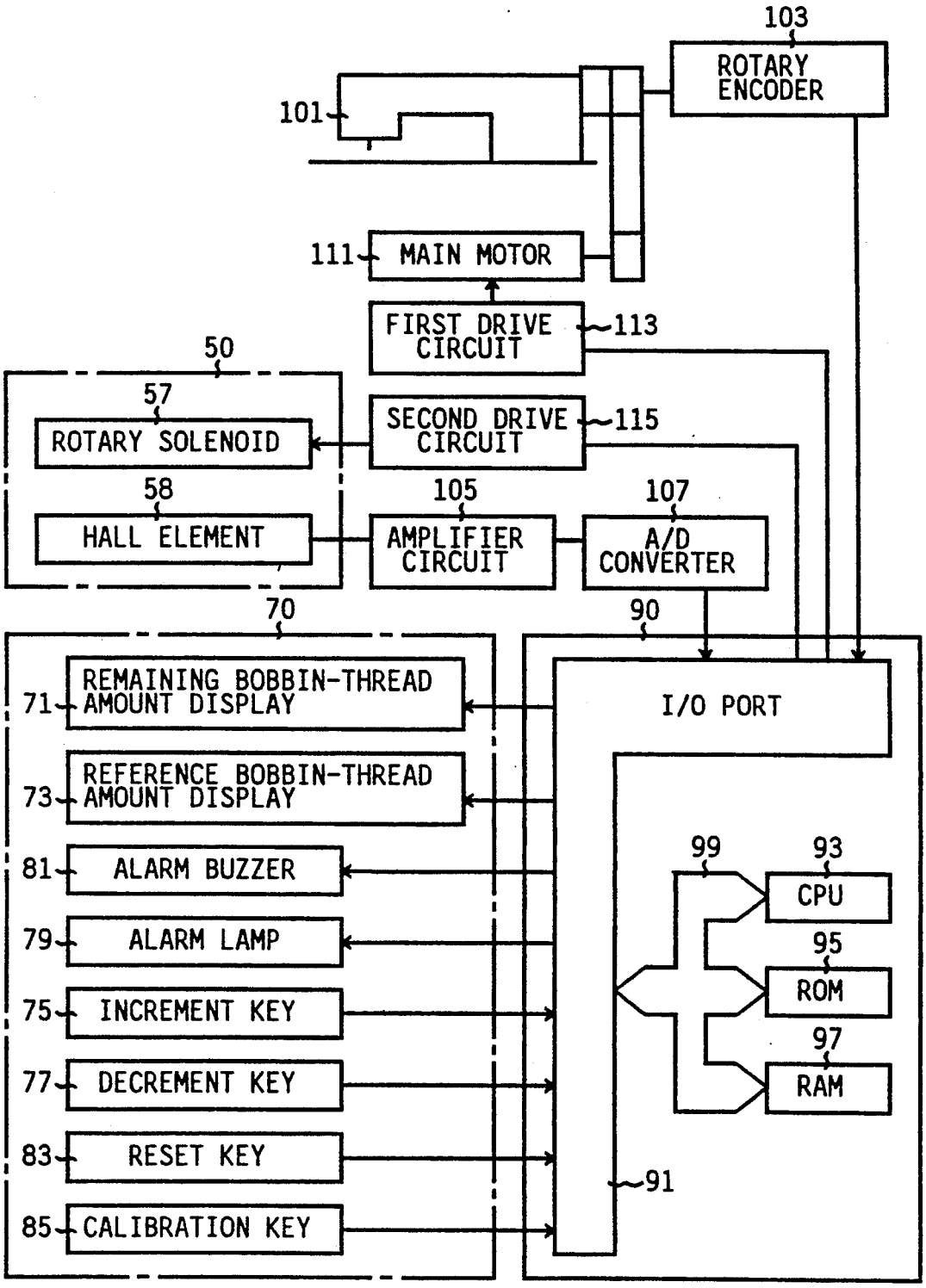
FIG. 5 is a diagrammatic view of the electric circuit of the measuring apparatus of FIG. 1.

As shown in FIG. 5, the detector part 50 and the display panel 70 are connected to the electronic control circuit 90 which serves for measuring the remaining amount of the bobbin thread 43, lighting the alarm lamp 79, and triggering the alarm buzzer 81. The control circuit 90 is essentially constituted by an input and output (I/O) port 91 for outputting signals to, and receiving signals from, the external devices; a central processing unit (CPU) 93 for processing signals or data; the ROM 95 for storing control programs including the remaining bobbin-thread amount measure routine (described in detail later); the RAM 97 for temporarily storing various data processed by the CPU 93; and electric bus line 99 for electrically connecting between the I/P port 91, CPU 93, ROM 95, and RAM 97 and transmitting signals to and from those components.

Upon operation of the increment key 75, decrement key 77, reset key 83, or calibration key 85 on the display panel 70, an appropriate signal is sent to the I/O port 91. Additionally, the output of a rotary encoder 103 which detects the angular position of a main shaft provided in an arm 101 of the sewing machine, is connected to the I/O port 91 of the control circuit 90. Furthermore, the voltage variation generated in the Hall element 61 is supplied, as the displacement signal indicative of the displacement amount of the measurement bar 53, to the I/O port 91 after being amplified by an amplifier circuit 105 and being converted into digital form by an analog to digital (A/D) converter 107.

The control circuit 90 generates, from the I/O port 91, drive signals to the first and second displays 71, 73 and the alarm lamp and buzzer 79, 81, respectively. Additionally, the control circuit 90 supplies drive signals to a main motor 111 for rotating the main shaft of the sewing machine arm 101 and the rotating hook 31 of the shuttle 30, and to the rotary solenoid 57 of the detector part 50, via a first and a second drive circuit 113, 115, respectively.

Figure 6:
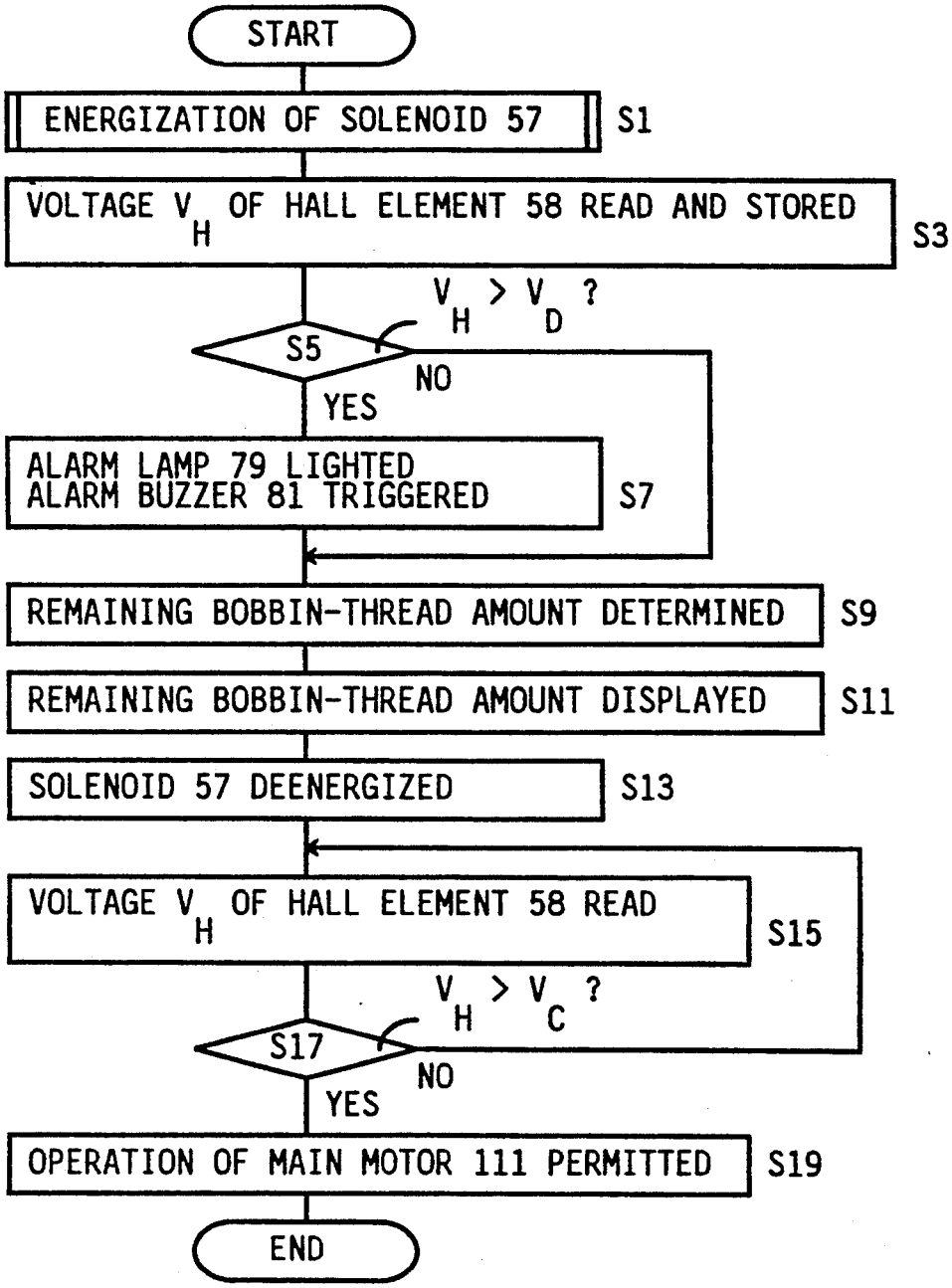
FIG. 6 is a flow chart representing a remaining bobbin-thread amount measure routine implemented by a control circuit of the measuring apparatus of FIG. 1.
Figure 7:
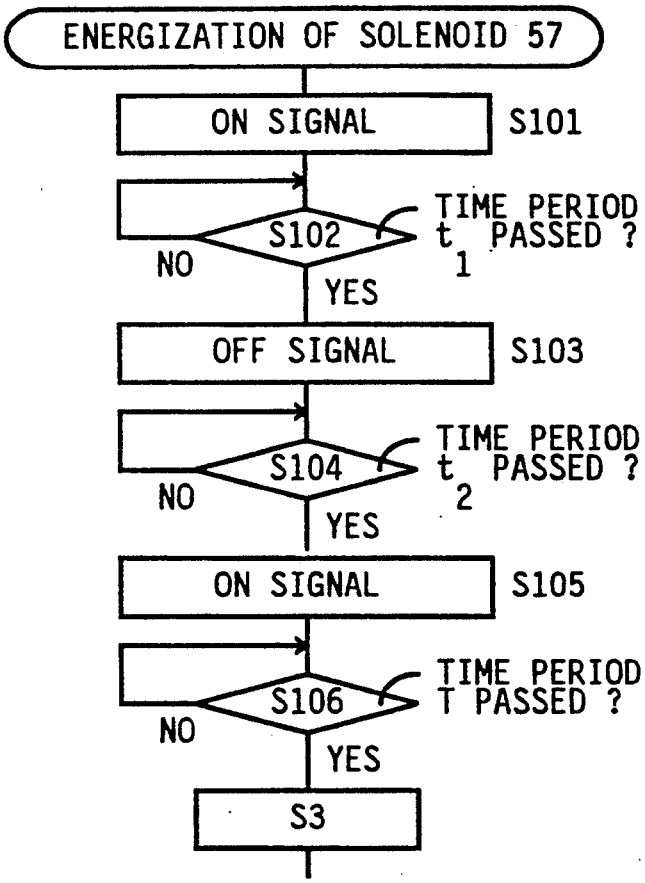
FIG. 7 is a flow chart representing a sub-routine serving as the solenoid energization step of the routine of FIG. 6.
Figure 8:
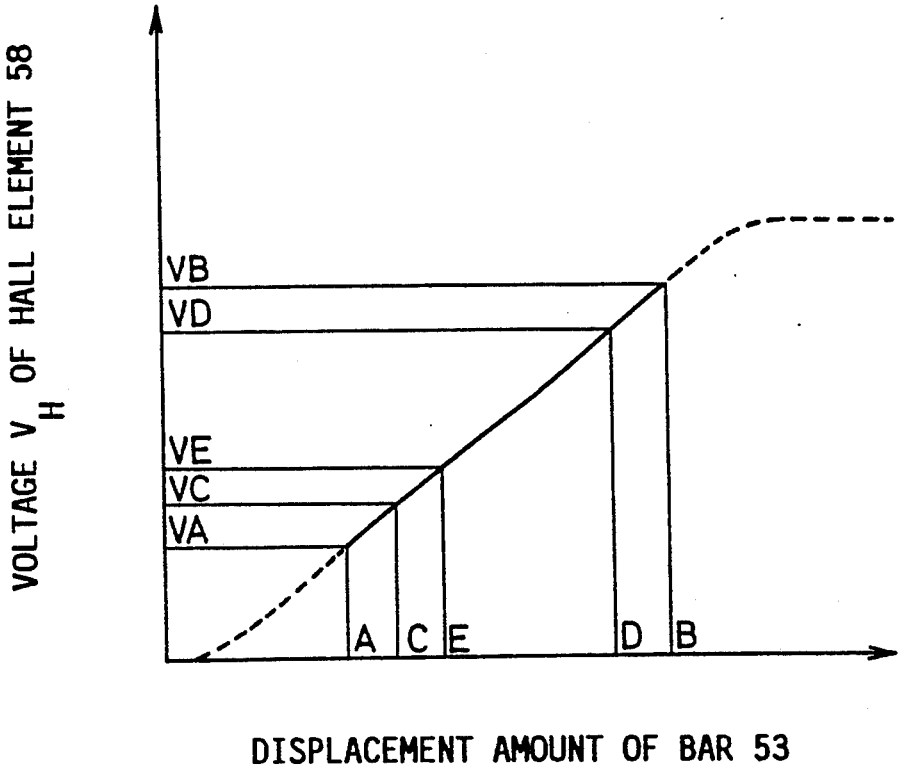
FIG. 8 shows a graph representing the relationship between the voltage of a Hall element and the displacement amount of the measurement bar.

Referring next to FIGS. 6, 7 and 8, there will be described the operation of the remaining bobbin-thread amount monitor constructed as described above. In the present embodiment, first, the control circuit 90 implements the signal characteristic determine and store routine, described briefly below, with a "blank" bobbin 45 with no bobbin thread 43 being set in the shuttle 30, before the sewing machine starts the sewing operation, and subsequently the control circuit 90 implements the remaining bobbin-thread amount measure routine represented by the flow charts of FIGS. 6 and 7.

Upon operation of the calibration key 85 while the sewing machine is not performing the sewing operation, i.e., while the main shaft of the machine arm 101 and the rotating hook 31 of the shuttle 30 are being stopped, the control circuit 90 starts the signal characteristic determine and store routine. In this routine, first, the control circuit 90 or CPU 93 determines the angular position or phase of the main shaft being stopped, based on the output (i.e., detection signal) of the rotary encoder 103, and identifies whether or not the main shaft is stopped at the predetermined angular position in which the first opening 32 of the rotating hook 31 is aligned with the aperture 37 of the bobbin case 39 and the second opening 34 of the bobbin case holder 33.

If the main shaft is not stopped at the predetermined angular position, the control of the CPU 93 automatically rotates the main shaft and stops the shaft at the predetermined angular position. Theses steps are provided for cases where the main shaft has been manually rotated before the calibration key 85 is operated after the main shaft is automatically stopped at the end of a prior sewing operation and consequently the first opening 32 is not aligned with the aperture 37 and the second opening 34. In such cases, the measurement bar 53 cannot be inserted into the bobbin case 39 through the aperture 37.

Subsequently, the control circuit 90 supplies the second drive circuit 115 with control signals, i.e., ON and OFF signals in a time sequence as shown in FIG. 3, so as to energize and deenergize the rotary solenoid 57. Consequently, the measurement bar 53 passes through the aperture 37 of the bobbin case 39, and contacts at the free end thereof the outer surface of the axial portion 41 of the bobbin 45 at a speed approximately equal to zero. As the measurement bar 53 displaces along the displacement path thereof, an electric voltage, $V_H$, generated in the Hall element 58 varies as shown in the graph of FIG. 8.

More specifically described, before the rotary solenoid 57 is energized, the measurement bar 53 stands at displacement start position, A (where $V_H=V_A$), and when the solenoid 57 is energized, the bar 53 is displaced up to a zero-amount position, B, at which the free end of the bar 53 contacts the outer surface of the axial portion 41 of the bobbin 45 with no bobbin thread thereon. Electric voltage $V_H$ generated in the Hall element 58 increases essentially directly proportionally tot he amount of displacement of the measurement bar 53 along the displacement path relative to the bobbin 45, as shown in FIG. 8. The control circuit 90 reads a current electric voltage $V_H$ of the Hall element 58 and stores in the RAM 97 the read value $V_H$ as a zero-amount voltage, $V_B$ (where $V_H=V_A$).

Subsequently, when the calibration key 85 is operated again, the control circuit 90 deenergizes the rotary solenoid 57 so that the measurement bar 53 is returned along the displacement path to displacement start position A. During this returning displacement, the bar 53 passes through a safety position, C, which is just away from (i.e., slightly apart from) the position where the displacement path of the bar 53 intersects the outer limit (i.e., outer surface) of the locus of rotation of the rotating hook 31. An electric voltage, $V_C$, of the Hall element 58 corresponding to safety position C, is prestored in the ROM 95. The positional relationship of the safety position C relative to displacement start position A and zero-amount position B depends upon the design or construction of a specific sewing machine. For example, the above-indicated positional relationship is defined by a linear function equation representing a straight line approximating a portion of the curve shown in FIG. 8 which portion corresponds to the voltage variation between the two extreme positions A and B.

If the rotation of the rotating hook 31 were started before the measurement bar 53 has passed through safety position C during the returning movement thereof, the bar 53 would interfere or collide with the rotating hook 31, which would result in damaging both the hook 31 and the bar 53. Therefore, in the present bobbin-thread monitor, before voltage $V_H$ of the Hall element 58 becomes lower than voltage $V_C$ corresponding to safety position C, the control circuit 90 inhibits the main motor 111 from starting to rotate the main shaft of the sewing machine arm 101 and the rotating hook 31 of the shuttle 30.

Meanwhile, the operator sets a single-figure value corresponding to a desired reference bobbin-thread amount, on the second display 73 by operating the increment and decrement keys 75, 77. Upon setting of the reference bobbin-thread amount on the second display 73, the control circuit 90 automatically calculates a voltage, $V_D$, of the Hall element 58 corresponding to the set reference bobbin-thread amount, according to the look-up table pre-stored in the ROM 95. Voltage $V_D$ is lower by a certain amount than voltage $V_B$. As described in detail below, the control circuit 90 lights the alarm lamp 79 and triggers the alarm buzzer 81 when current voltage $V_H$ of the Hall element 58 exceeds voltage $V_D$.

Subsequently, the operator inserts a bobbin 45 on which a certain amount (e.g., upper-limit amount) of bobbin thread 43 is wound, into the shuttle 30, and starts sewing operation on the sewing machine. During the sewing operation, the control circuit 90 monitors the detection signal from the rotary encoder 103 and, when the main shaft is stopped and simultaneously the rotating hook 31 is stopped at the predetermined angular position, the control circuit 90 automatically initiates the remaining bobbin-thread amount measure routine represented by the flow charts of FIGS. 6 and 7.

First, at Step $S_1$, the control circuit 90 or CPU 93 energizes the rotary solenoid 57. As described previously, in the present situation, the first opening 32 of the rotating hook 31 is aligned with the second opening 34 of the bobbin case holder 33 and the aperture 37 of the bobbin case 39. Therefore, the measurement bar 53 is permitted to pass through the aperture 37, so that the free end of the bar 53 contacts the outer surface of the roll of bobbin thread 43 remaining on the bobbin 45.

The energization of the rotary solenoid 57 at Step S1 will be described in detail by reference to FIGS. 7 and 3. At Step S101 of FIG. 7, the control circuit 90 supplies an ON signal to the second drive circuit 115 so as to energize the rotary solenoid 57. Step S101 is followed by Step S102 to judge whether or not time period $t_1$ has passed. Step S102 is repeated till a positive judgment is made, then the control goes to Step S103 to supply an OFF signal to the drive circuit 115 so as to deenergize the solenoid 57. Step S103 is followed by Step S104 to judge whether or not time period $t_2$ has passed. Step S104 is repeated till a positive judgment is made, subsequently the control goes to Step S105 to again supply an ON signal to the second drive circuit 115 so as to energize the solenoid 57. Thus, the measurement bar 53 contacts the bobbin thread 43 remaining on the bobbin 45. Step S105 is followed by Step S106 to judge whether or not time period T has passed as counted from the start of time period $t_1$. Step S106 is repeated till a positive judgment is made, subsequently the control goes to Step S3 of the main routine of FIG. 6.

At Step S3, the CPU 93 reads current voltage $V_H$ of the Hall element 58 in this situation, i.e., when the free end of the bar 53 contacts the outer surface of the bobbin thread 43 remaining on the bobbin 45. Step S3 is followed by Step S5 to judge whether or not the read voltage $V_H$ is higher than voltage $V_D$ corresponding to the selected reference bobbin-thread amount. If a negative judgment is made at Step S5, the control goes to Step S9. On the other hand, if a positive judgment is made at Step S5, the control goes to Step S7 to light the alarm lamp 79 and additionally trigger the alarm buzzer 81 so as to issue an alarm sound. Then, the control proceeds with Step S9.

At Step S9, the CPU 93 calculates a remaining bobbin-thread amount, R, in percentage according to the following expression, and stores the calculated value R in the RAM 97:

$$R=\{(V_B-V_H)/(V_B-V_E)\}\times 100\ (\%)$$

In the above equation, voltage, $V_E$, of the Hall element 61 corresponds to a relative position (hereinafter, referred to as the full-amount position), E, of the measurement bar 53 where the free end of the bar 53 contacts the outer surface of the roll of bobbin thread 43 which is wound on the bobbin at the upper-limit amount, i.e., 100%. Since the axial-end flanges of a common bobbin 45 has standardized dimensions, full-amount position E of the bar 53 is also defined by the construction of a specific sewing machine. Voltage $V_E$ is pre-stored in the ROM 95.

Step S9 is followed by Step S11 to indicate on the first display 71 the remaining bobbin-thread amount R determined at Step S9, and subsequently by Step S13 to deenergize the rotary solenoid 57. Then, as previously described, the bar 53 starts returning toward displacement start position A. At the following Step S15, the CPU 93 reads current voltage $V_H$ of the Hall element 58. Step S15 is followed by Step S17 to judge whether or not the read current voltage $V_H$ has become less than voltage C corresponding to safety position C. If a positive judgment is made at Step S17, the control goes to Step S19. On the other hand, if the bar 53 has not passed through safety position C yet, i.e., if a negative judgment is made at Step 17, the control returns to Step S15.

If the rotation of the rotating hook 31 were started before the measurement bar 53 has passed through safety position C during the returning movement thereof, the bar 53 would interfere or collide with the rotating hook 31, which would result in damaging both the hook 31 and the bar 53. Steps S15 and S17 are provided for ensuring that the bar 53 has passed through safety position C. At Step S19, the CPU 93 permits the main motor 111 to operate, i.e., rotate the main shaft of the sewing machine arm 101 and the rotating hook 31 of the shuttle 30. Thus, the implementation of the routine of FIG. 6 terminates.

As is apparent from the foregoing description, the present remaining bobbin-thread amount monitor energizes and deenergizes the rotary solenoid 57 with a specific sequence of ON and OFF signals, so that the measurement bar 53 contacts the bobbin thread 43 remaining on the bobbin 45 at a speed which does not cause breakage or damage of the bobbin thread 43. Stated differently, the specific signal sequence is predetermined such that, if and when the bar 53 would contact the axial portion 41 of the bobbin 45 on which no bobbin thread 43 is assumed to remain, the speed of the bar 53 would be approximately equal to zero. Thus, the present monitor apparatus performs the remaining bobbin-thread amount measurement by effectively avoiding breakage of the bobbin thread 43. Additionally, since is minimized the force of impact exerted to the measurement bar 53, bobbin 45, bobbin case 39 and rotating hook 31 when the bar 53 contacts the bobbin 45, the durability of those members 53, 45, 39, 31 is improved.

In addition, in the present embodiment, energization and deenergization time periods $t_1$, $t_2$ are pre-fixed such that the speed of the measurement bar 53 becomes substantially equal to zero just at a specific timing when the bar 53 would contact the outer surface of the axial portion 41 of the bobbin 45 on which no bobbin thread 43 is assumed to remain. Around that timing, the bobbin thread 43 will particularly frequently break due to being nipped between the bar 53 and the bobbin 45. Thus, the present monitor apparatus provides the above-indicated advantages with simple construction and simple control program.

Figure 9A:
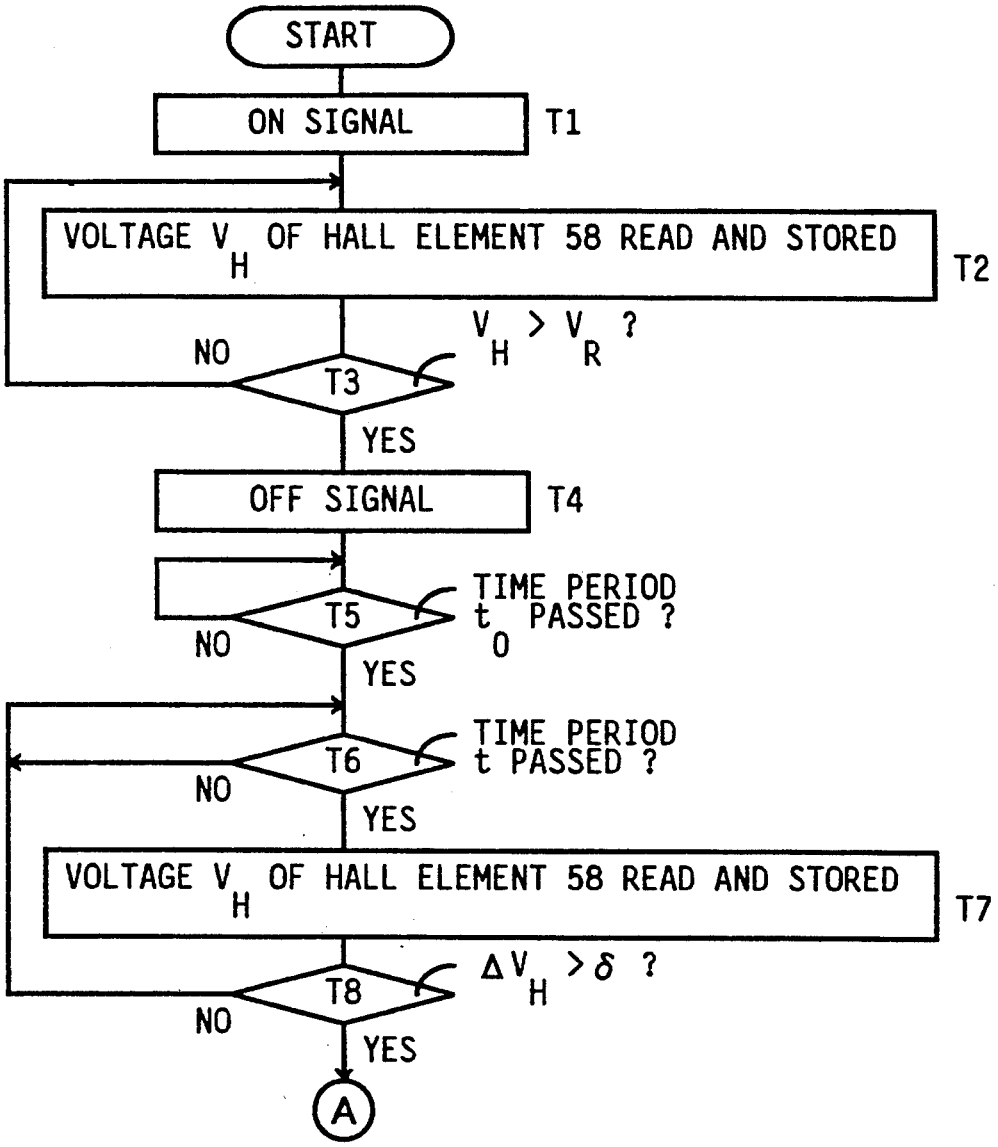
FIGS. 9A and 9B are flow charts representing a different remaining bobbin-thread amount measure routine implemented by the measuring apparatus of FIG. 1.
Figure 9B:
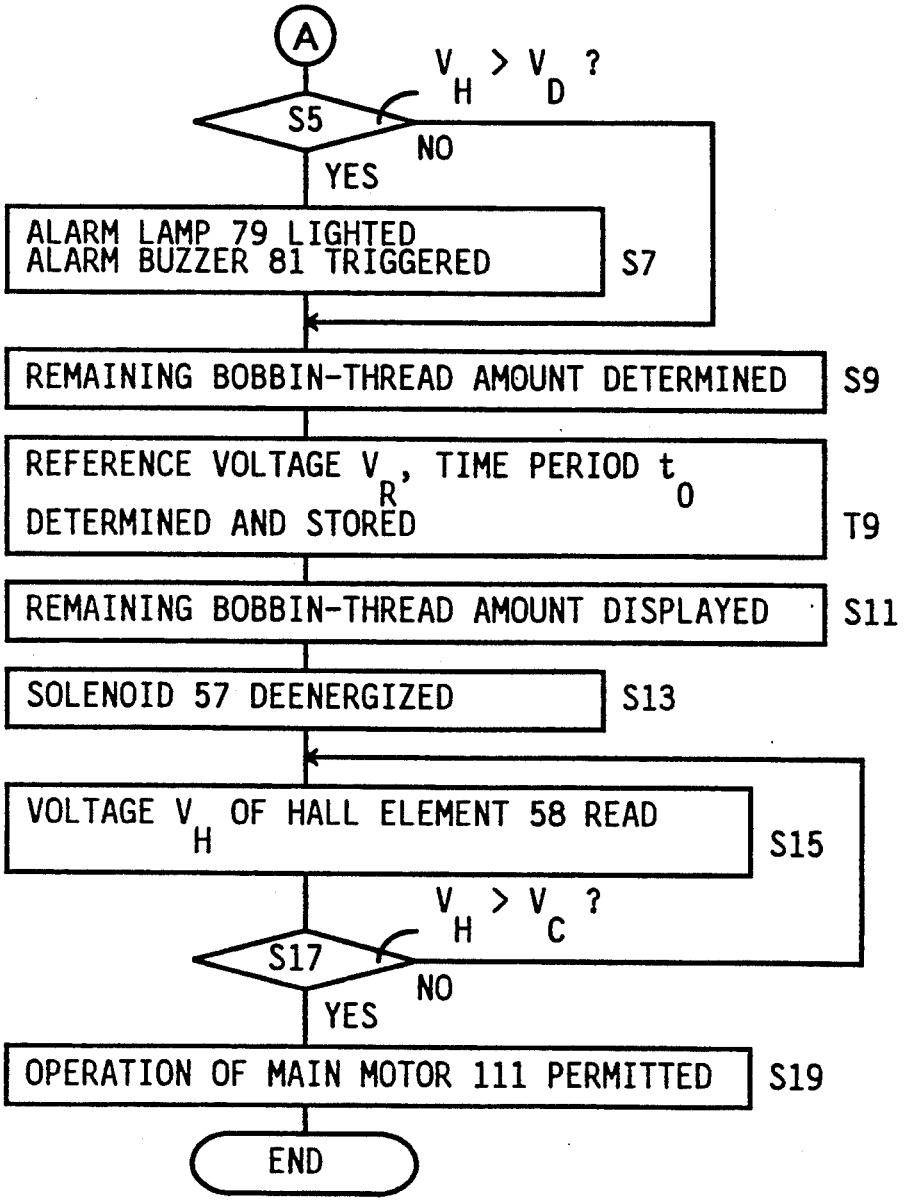

Referring next to FIGS. 9A and 9B, there will be described the second embodiment of the present invention which relates to a remaining bobbin-thread amount monitor like the first embodiment shown in FIGS. 1–8. The present monitor apparatus as the second embodiment has a similar construction to that of the first embodiment. However, the present monitor operates according to a control program represented by the flow charts of FIGS. 9A and 9B in place of the control program represented by the flow charts of FIGS. 6 and 7. In the flow charts f FIGS. 9A and 9B, Steps T1–T8 are provided in place of Steps S1 and S3 of FIG. 6, and Step T9 is inserted between Steps S9 and S11. The same steps as Steps S5 to S19 of FIG. 6 are also implemented in the second embodiment but the explanation thereof is omitted from the following description. In the second embodiment, a control circuit 90 controls, based on the remaining amount of bobbin thread 43 determined in a preceding measurement cycle, the rotary solenoid 57 in a current measurement cycle following the preceding cycle so as to displace a measurement bar 53 such that, when the bar 53 contacts the bobbin thread 43 remaining on a bobbin 45 in the current cycle, the speed of the bar 53 is substantially equal to a predetermined value. Preferably, the predetermined value is zero.

At Step Tl in a current measurement cycle, the control circuit 90 supplies an ON signal to a drive circuit 115 so as to energize the rotary solenoid 57, and at Step T2 the control circuit 90 reads a current voltage $V_H$ of a Hall element 58. Step T2 is followed by Step T3 to judge whether or not the read voltage $V_H$ has reached a reference voltage, $V_R$. Reference voltage $V_R$ is determined, at Step T9 in the preceding measurement cycle, based on voltage, $V_{HP}$, corresponding to remaining bobbin-thread amount, $R_P$, determined in the preceding cycle. Specifically, first, energization time period, $t_1'$, is determined such that when the solenoid 57 is energized in time period $t_1'$, the bar 53 is displaced over just a displacement amount corresponding to voltage $VH_P$, so as to contact the bobbin thread 43 at a speed substantially equal to zero. Reference voltage $V_R$ corresponds to energization time period $t_1'$. Loop-up tables which define the correspondence relationship between energization time periods $t_1'$ and voltages $V_{HP}$ and the correspondence relationship between reference voltages $V_R$ and energization time periods $t_1'$, are pre-stored in the ROM 95. Alternatively, energization time period $t_1'$ may be determined by considering a maximum amount of consumption of bobbin thread 43, $\Delta V_{HMAX}$ (in terms of voltage), between the preceding and current remaining bobbin-thread measurement cycles, i.e., during one continuous sewing operation. In the latter case, time period $t_1'$ may be determined such that when the solenoid 57 is energized in time period $t_1'$, the bar 53 is displaced over the displacement amount corresponding to voltage $V_{HP}$ plus a displacement amount corresponding to voltage $\Delta V_{HMAX}$.

If a negative judgment is made at Step T3, the control goes back to Step T2 to repeat Steps T2 and T3. Meanwhile, if a positive judgment is made at Step T3, the control goes to Step T4 to supply an OFF signal to the drive circuit 115 to deenergize the solenoid 57. Step T4 is followed by Step T5 to judge whether or not a time period, $t_0$, has passed as counted from the start of time period $t_1'$. Time period $t_0$ is determined, together with reference voltage $V_R$, at Step T9 in the preceding cycle, based on voltage $V_{HP}$ corresponding to remaining bobbin-thread amount $R_P$ determined in the preceding cycle. Specifically, time period $t_0$ is determined such that when the solenoid 57 is energized in time period $t_1'$, time period $t_0$ is needed for the bar 53 to displace over just the displacement amount corresponding to voltage $V_{HP}$, or over the displacement amount corresponding to voltage $V_{HP}$ plus the displacement amount corresponding to voltage $\Delta V_{HMAX}$. Loop-up table which defines the correspondence relationship between time periods $t_0$ and voltages $V_{HP}$, or the correspondence relationship between time periods $t_0$, and voltages $V_{HP}$ plus voltage $\Delta V_{HMAX}$, is pre-stored in the ROM 95. When time period $t_0$ has just passed after the start of time period $t_1'$, the bar 53 will contact the bobbin thread 43 remaining on the bobbin 45 at approximately the predetermined speed. Step T5 is repeated till a positive judgment is made.

Meanwhile, if a positive judgment is made at Step T5, the control goes to Step T6 to judge whether or not a very short time, t, has passed after the last reading of current voltage $V_H$. Step T6 is repeated till a positive judgment is made, then the control goes to step T7 to read a current voltage $V_H$ of the Hall element 58. Step T7 is followed by Step T8 to judge whether or not an increased voltage, $\Delta V_H$, becomes smaller than a very small value, $\delta$. A positive judgment made at Step T8 means that the measurement bar 53 has surely contacted the bobbin thread 43 on the bobbin 45. Subsequently, the control goes to Step S5 to judge whether or not the last read voltage $V_H$ is greater than voltage $V_D$. The following steps are implemented in the same manners as described previously with respect to the corresponding steps in the flow chart of FIG. 6.

In the second embodiment, when the measurement bar 53 is driven by the rotary solenoid 57, the bar 53 contacts any amount of bobbin thread 43 remaining on the bobbin 45, at a speed approximately equal to the predetermined value, preferably zero. Therefore, the free end of the bar 53 does not bite into, and thereby deform, the outer surface of the roll of bobbin thread 43, that is, just stops in contact with the outer surface of the roll of bobbin thread 43. Thus, the displacement amount of the bar 53 accurately corresponds to the remaining amount of the bobbin thread 43. Stated differently, the accuracy of measurement of the remaining bobbin-thread amount is improved in the present monitor apparatus.

While in the illustrated two embodiments the Hall element 58 is used for measuring the displacement amount of the measurement bar 53, it is possible to employ a different displacement sensor such as a variable-capacitance capacitor, a differential transformer, a potentiometer, or a magneto-resistive element associated with a "linear scale" which is constituted by a multiplicity of magnetic poles arranged in an array in which S poles and N poles alternate with each other in the direction of arrangement of the poles' array.

Although in the illustrated embodiments the shuttle 30 is of "horizontal-rotation" type wherein the shuttle 30 has a horizontal rotation axis and the bobbin case 39 is employed to hold the bobbin 45, the principle of the present invention may be applied to a sewing machine in which is employed a shuttle of "vertical-rotation" type wherein the rotation axis of the shuttle is vertical and no bobbin case is used. Therefore, the construction of the vertical rotation-type shuttle remains simple as compared with the horizontal rotation-type shuttle 30.

While in the illustrated embodiments the measurement bar 53 is inserted into the shuttle 30 while the rotation of the rotating hook 31 is stopped, it is possible to insert the bar 53 into the shuttle 30 while the hook 31 is rotating, if the hook 31 rotates at a very low speed.

The rotary solenoid 57 and the arm member 56 employed in the illustrated embodiments may be replaced by a linear solenoid which linearly displaces the slider member 55 toward the shuttle 30. Alternatively, a direct-current motor and a feed screw rotated by the motor may be used to displace the slide member 55 or measurement bar 53. In the latter case, the displacement speed of the bar 53 can be changed as desired by changing the magnitude of direct current supplied to the motor.

While the present invention has been described in detail with the specific particulars of the illustrated embodiments and their variations, it is to be understood that the present invention may be embodied with other changes, improvements, and modifications that may occur to those skilled in the art without departing from the spirit and scope of the invention defined in the appended claims.

What is claimed is:

1. An apparatus for measuring a remaining amount of a bobbin thread which is wound around a bobbin accommodated in a shuttle of a sewing machine, comprising:

a measurement bar which is displaceable along a displacement path from outside the shuttle toward an axis line of the bobbin inside the shuttle;

a measurement-bar driver which displaces said measurement bar along said displacement path so that a free end of the measurement bar contacts an outer surface of a roll of the bobbin thread remaining on the bobbin;

a displacement-speed control device for controlling said measurement-bar driver to displace the free end of the measurement bar into contact with the outer surface of the roll of the bobbin thread at a speed lower than a highest speed of the displacement of the bar along said displacement path; and remaining-amount determining means for determining said remaining amount of the bobbin thread on the bobbin, based on an amount of the displacement of said measurement bar along said displacement path when the free end of the measurement bar contacts the outer surface of the roll of the bobbin thread.

2. An apparatus according to claim 1, wherein said measurement-bar driver comprises an electric solenoid, said displacement-speed control device energizing said electric solenoid in at least one energization period of time and deenergizing said solenoid in at least one deenergization period of time such that said energization and deenergization periods are alternate with each other.

3. An apparatus according to claim 2, wherein said alternate energization and deenergization periods consist of an energization period and a subsequent deenergization period.

4. An apparatus according to claim 2, wherein said alternate energization and deenergization periods consist of a first energization period, a deenergization period, and a second energization period in time sequence.

5. An apparatus according to claim 1, wherein said displacement-speed control device controls said measurement-bar driver to displace said measurement bar such that, when the measurement bar contacts the bobbin on which approximately no said bobbin thread remains, the speed of the bar is equal to a value which does not cause breakage of the bobbin thread being nipped between the bobbin and the bar.

6. An apparatus according to claim 5, wherein said displacement-speed control device controls said measurement-bar driver to displace said measurement bar such that, when the measurement bar contacts the bobbin on which approximately no said bobbin thread remains, the speed of the bar is substantially equal to zero.

7. An apparatus according to claim 1, wherein said displacement-speed control device controls, based on the remaining amount of the bobbin thread determined in a prior measurement cycle, said measurement-bar driver in a current measurement cycle to displace said measurement bar such that, when the measurement bar contacts the bobbin thread remaining on the bobbin in said current measurement cycle, the speed of the bar is substantially equal to a predetermined value.

8. An apparatus according to claim 7, wherein said predetermined value is zero.

9. An apparatus according to claim 1, further comprising a displacement sensor which detects the displacement of said measurement bar, said sensor generating a displacement signal representative of said amount of the displacement of the measurement bar along said displacement path.

10. An apparatus according to claim 1, wherein said displacement sensor comprises a Hall element and a permanent magnet.

11. An apparatus according to claim 1, further comprising a display device which displays said remaining amount of the bobbin thread determined by said remaining-amount determining means.

12. An apparatus according to claim 1, wherein the shuttle includes a rotating hook, the apparatus further comprising an inhibiting device which inhibits operation of a driver which rotates the rotating hook, for at least a time duration in which the free end of said measurement bar is located between the bobbin and an outer limit of a locus of rotation of the shuttle on said displacement path.

13. An apparatus according to claim 1, wherein the shuttle includes a rotating hook, the apparatus further comprising an operation control device which automatically starts operation of said measurement-bar driver to displace said measurement bar along said displacement path, so that said remaining-amount determining means determines said remaining amount of the bobbin thread, in a condition in which the rotating hook is being stopped at a non-interference angular position where the hook does not interfere with said displacement path along which said measurement bar displaces.

14. An apparatus according to claim 13, wherein said operation control device automatically starts the operation of said measurement-bar driver so that said remaining-amount determining means determines said remaining amount of the bobbin thread each time the rotating hook is stopped at said non-interference angular position.

15. An apparatus according to claim 1, wherein the shuttle includes a rotating hook, the apparatus further comprising a rotating device which automatically rotates the rotating hook to a non-interference angular position where the hook does not interfere with said displacement path, in a condition in which the hook is being stopped at an angular position different from said non-interference angular position.

16. An apparatus according to claim 1, wherein said measurement-bar driver comprises:

an actuator including an output member; and a connector member provided between said output member of said actuator, and said displacement bar, so as to connect the output member and the displacement bar to each other such that the bar is displaceable along an axis line thereof together with the connector member when the output member is moved by said actuator.

17. An apparatus according to claim 16, wherein said actuator comprises a rotary actuator which rotates said output member about an axis line of the actuator so that the output member displaces said measurement bar along said axis line thereof.

18. A bobbin-thread supplying apparatus for supplying a bobbin thread which cooperates with a needle thread carried by a sewing needle of a sewing machine to form stitches into a work sheet, comprising:

(A) a shuttle including a bobbin around which said bobbin thread is wound, a rotating hook which is rotatable for catching said needle thread, said rotating hook defining an outer limit of a locus of rotation of the shuttle, a rotating-hook driver which rotates said rotating hook;

(B) a remaining bobbin-thread amount measuring device including a measurement bar which is displaceable along a displacement path from outside the shuttle toward an axis line of the bobbin inside the shuttle, a measurement-bar driver which displaces said measurement bar along said displacement path so that a free end of the measurement bar contacts an outer surface of a roll of the bobbin thread remaining on the bobbin, a displacement-speed control device by controlling said measurement-bar driver to displace the free end of the measurement bar into contact with the outer surface of the roll of the bobbin thread at a speed lower than a highest speed of the displacement of the bar along said displacement path, remaining-amount determining means for determining said remaining amount of the bobbin thread on the bobbin, based on an amount of the displacement of said measurement bar along said displacement path when the free end of said measurement bar contacts the outer surface of the roll of the bobbin thread; and (C) an operation control device which controls operation of said rotating-hook driver and operation of said remaining bobbin-thread amount measuring device.

19. A bobbin-thread supplying apparatus according to claim 18, wherein said shuttle further includes a bobbin case which accommodates said bobbin, said bobbin case having an aperture which allows the free end of said measurement bar to pass therethrough and contact the outer surface of the roll of the bobbin thread remaining on the bobbin.

* * * * *